United States Patent [19]

Dufour et al.

[11] Patent Number: 4,842,929

[45] Date of Patent: Jun. 27, 1989

[54] PAPERMAKER'S WET PRESS FELT WITH PREDENSIFIED BATT THEREON

[75] Inventors: Marcel Dufour, Saint Yrieix; Jacques Piat, Fléae, both of France

[73] Assignee: Asten Group, Inc., Charleston, S.C.

[21] Appl. No.: 162,556

[22] Filed: Mar. 1, 1988

[51] Int. Cl.[4] ..... B32B 5/06

[52] U.S. Cl. ..... 428/300; 428/234; 428/280; 428/282; 428/284

[58] Field of Search ..... 428/280, 282, 300, 234, 428/284

[56] References Cited

U.S. PATENT DOCUMENTS

| | | | |
|---|---|---|---|
| 1,742,338 | 1/1930 | Bettison | 28/111 |
| 3,192,598 | 7/1965 | Stevenson et al. | 28/111 |
| 3,199,166 | 8/1965 | Petersik | 28/107 |
| 3,230,599 | 1/1966 | McKew et al. | 28/72.2 |
| 3,368,256 | 2/1968 | Fehrer et al. | 28/107 |
| 4,342,802 | 8/1982 | Pickens et al. | 428/234 |
| 4,536,927 | 8/1985 | Feyerl et al. | 28/110 |
| 4,755,423 | 7/1988 | Greiser et al. | 428/300 |
| 4,764,417 | 8/1988 | Gulya | 428/300 |

*Primary Examiner*—James J. Bell

*Attorney, Agent, or Firm*—Volpe and Koenig

[57] ABSTRACT

Process of manufacturing felts in which a batt is fastened to a felt on its one or two sides, said batt (5) consisting of one or several layers of fibers and characterized in that said layers are obtained from carding the fibers and possibly preneedling them by passage through a preneedling machine with low density needles, said layers being densified by at least three passages through a needling machine (1) with high needle density, and at least one of those passages going in the opposite direction of the others, said batt (5) created in such a way then being fastened to the felt (10).

The wet felt obtained in this way has very good cohesion and very high resistance, and the felt is neither damaged nor filled with fibers, which provides it with good air and water permeability.

The invention also relates to a machine to densify batts.

6 Claims, 1 Drawing Sheet

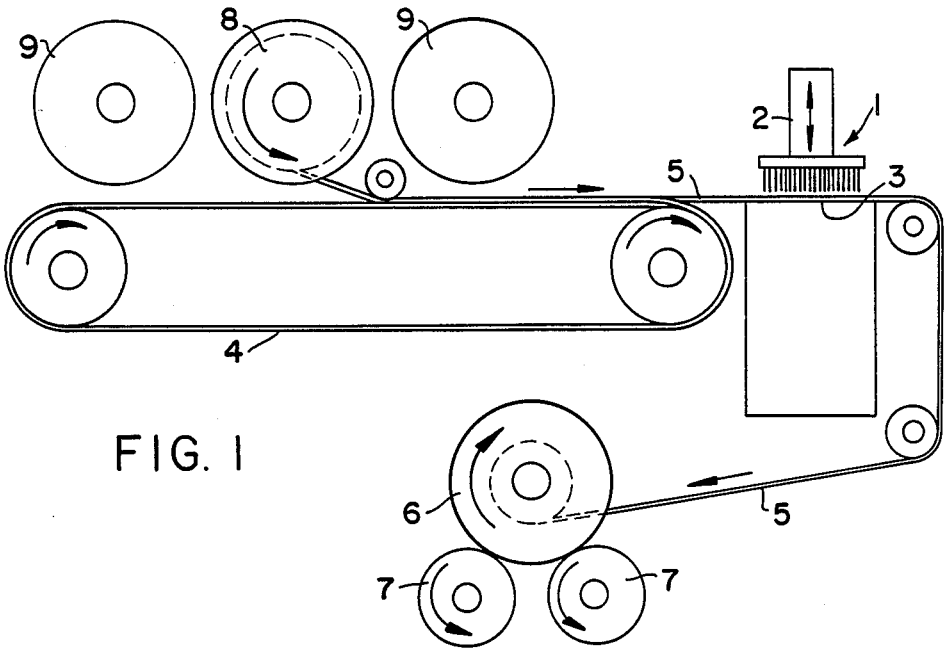
FIG. 1
FIG. 2
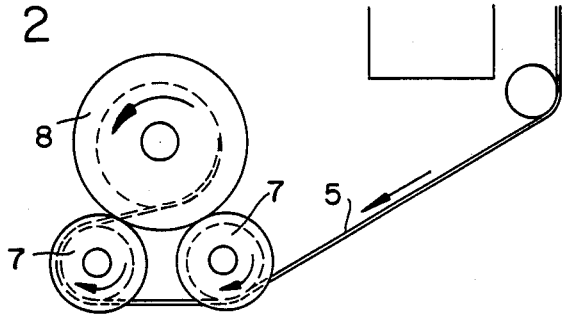
FIG. 3
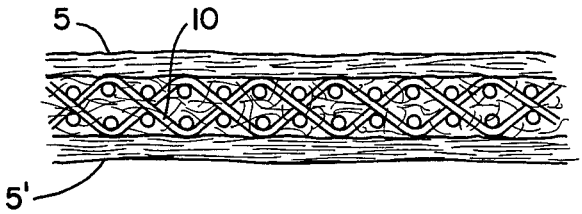

PAPERMAKER'S WET PRESS FELT WITH PREDENSIFIED BATT THEREON

The present invention relates to a process of manufacturing wet felts for the paper industry in which a batt, that consists of several layers of fibers, is fastened to at least on side of the felt.

In the known prior art processes, this fastening of the batt to the felt is accomplished in a needling process. There are two types of these processes.

According to the first method, successive layers of fibers, from a card, are placed directly on the base fabric which is secured on a needling machine. The felt continuously moves and passes under a high density needle head so that the batt, comprising successive layers, is directly needled into the felt.

According to the second method, the batt is prefabricated and is then placed on the base fabric and needled onto it. In this case, the fiber layer from the card is put on a moving conveyor. The conveyor guides the batt, which is made of successive layers, under the needle head of a preneedling machine. the preneedling is done with a low density needle head and creates a cohesion that makes it possible to form a roll of batt which will then be unrolled onto the base fabric which is processed in the needling machine in order to form the felt. A preneedling head will have a density of about 1,000 needles per meter.

In order for the batt to be fastened properly to the felt and give them good cohesion, the actual needle used in the needling process of these batts must be densely arranged in the head and must be pushed into the felt.

The inventors noticed, however, that this procedure damaged the felt because of needle density and penetration on the one hand and because the base fabric of the felt is blocked up by the fibers of the batt, which reduces its air and water permeability significantly.

The process according to the invention makes it possible to avoid the problems of the prior needling process in that the fiber layers, from carding, are densified by at least three passages, through a needling machine head with very dense needles, with at least one of the passages being accomplished in the opposite direction of the other passages; the resulting predensified batt is fastened to the felt is a subsequent less severe needling operation with a lesser density needling head.

The batts fastened in this manner of the invention have very good stability in the machine direction and the cross machine direction. Thus, one can fasten these batts onto the felt with a light needling process or even possibly fasten them by gluing.

In making the final batt covered felt, it is no longer necessary to make several passages through the needling processes with the associated damages, in order to give cohesion to the batts; one or two passes through the less dense needle head will suffice.

If the felt is an open felt with a base fabric which will be closed with a seam, the existence of the predensified batt makes it possible to create a flap of batt material to cover the area of the seam and the flap will have sufficient resistance to prevent seam marking.

The invention also relates to a machine intended for the predensification of the batts, said machine being characterized in that it consists of a needling machine with a very dense head of needles, a device to collect the needled batt when exiting the needling machine, the device consisting of a removable rotating exit roll on which the batt from the needling machine is rolled up, a feed-in device that consists of a removable roll which is identical to the roll placed at the exit of the machine, on which the already needled batt can be rolled up, and a transfer device to bring this batt under the head of the needling machine, said exit roll being able to rotate in both directions.

SUMMARY OF THE INVENTION

A process of manufacturing felts, in which a batt (5) is fastened to a felt on its one to two sides, said batt (5) consisting of one or several layers of fibers, and characterized in that said layers are obtained from carding of the fibers and are possibly preneedled by passage through a preneedling machine that has low needle density, said layers being densified by at least three passages through a needling machine (1) with high needle density, and at least one of those passages going in the opposite direction of the others, said batt (5) created in such a way then being fastened to the felt (10).

BRIEF DESCRIPTION OF THE DRAWINGS

FIG. 1 represents a machine to densify batts according to the invention.

FIG. 2 represents a particular operation of the machine in FIG. 1.

FIG. 3 represents a felt manufactured according to the process of the invention.

DESCRIPTION OF THE PREFERRED EMBODIMENTS

The invention will now be described in more detail by making reference to a particular way of implementing this process which is a non-limited example only, and is represented in the attached drawing.

FIG. 1 represents a machine to densify batts, consisting of a needling machine (1) that is equipped with a head (2) of very dense needles. This head is typically about 40 cm wide and will have a needle density of 3,000 needles per meter length. As noted, the prior art preneedling machines with low density needling have only 1,000 needles per meter length for a similar 40 cm wide head. Thus, needling head density approaches a ratio of three to one.

The high density head (2) is placed on top of a needling matrix (3), as will be known to those skilled in the art.

A conveyor (4) guides the batt material (5) between the head (2) and the matrix (3). At the exit point of the needling machine, a take up roll (6) is installed and is responsive to motorized motor rolls (7). The needled batt (5) is rolled around the roll (6).

At the entrance of the needling machine, there is a supply roll (8), which has the same size as the roll (6) of batt material positioned above of the conveyor (5). Rolls (6) and (8) are removable and interchangeable, and the rolls (7) adjacent roll (6) can change their rotational direction. There are also auxiliary supply rolls (9) at the entrance of the machine on top of the conveyor.

The machine according to the invention operates in the following way: A low density preneedled batt (5) is placed around roll (8). This batt (5) is rolled out between the high density head (2) and the matrix (3) of the needling machine, which highly densifies the batt. When roll (8) has been emptied, it is exchanged with the full roll (6). The batt is once again passed through the needling machine (1). Due to the interchange, the needling will be on what may be considered as this time the back of the batt.

For this second pass, the batt will extend around rolls (7) prior to being rolled on take up roll 8. In addition, the rotation direction of rolls (7) and the take up roll are reversed. Due to this turning in the opposite direction (see FIG. 2), the third and the last passage will needle the back of the batt just like the second passage.

It was in fact noticed that very good densification was obtained when needling the last two passages in the same direction, which is the opposite direction of the antepenultimate passage prior to the end of the process.

When starting out with several layers of carded fibers, instead of a low density preneedled batt, the layers during the first passage will be rolled on rolls (8) and (9) and will be rolled off by the conveyor (4) under the head (2) of the needing machine (1). Once again the needling head will be a high density head.

With reference to FIG. 3, once the upper batts (5) and/or lower batts (5') are densified, this batt or these batts are fastened to the base of the felt (10) by needling or gluing thereto. This attachment, if by needling, will be accomplished with low density heads, in order to finish the felt. Only one or two additional needling passages are all that is needed. This low density needling prevents the felt from being damaged and from being blocked by fibers Thus, the order of needling density has been reversed from that of the prior art with the associated benefit that minimum damage is done to the base fabric's structure and permeability. One can not only manufacture closed felts, but also open felts such as the one described in document EU-A No. 0193075.

What I claim is:

1. An improved wet press felt of the type having a base which is combined with at least one batt consisting of multiple fiber layers, the improvement characterized in that prior to being combined with said base said batt is predensified by at least three passages through a needling machine having a high needle density board on the order of 3,000 needles per meter of length for a 40 centimeters width and with at least one of those passages in the opposite direction of the others.

2. The wet press felt of claim 1 further characterized in that the belt is fastened onto the base felt by needling.

3. The wet press felt of claim 1 further characterized in that the batt is fastened onto the base felt by low density needling through a needling machine with a needle density on the order of 1,000 needles per meter of length for a 40 centimeter width.

4. An improved wet press felt of the type comprising a base felt in combination with at least one densified batt comprised of multiple fiber layers, the improvement characterized in that said batt was predensified, before combination with the base felt, by at least three passages through a needling machine having a high needle density board on the order of 3,000 needles per meter of length for a 40 centimeters width with at least one of those passages in the opposite direction of the others so that no substantial additional batt densification resulted from the combination with the base felt.

5. The wet press felt of claim 4 further characterized in that the batt was fastened onto the base felt by low density needling through a needling machine with a needle density on the order of 1,000 needles per meter of length for a 40 centimeter width.

6. The wet press felt of claim 4 further characterized in that the batt was fastened onto the base felt by adhesive means.

* * * * *